United States Patent [19]

Goumy et al.

[11] Patent Number: 4,644,995

[45] Date of Patent: Feb. 24, 1987

[54] DEVICE FOR FABRICATING FROZEN MOULDING MOULDS OR CORES

[75] Inventors: Daniel Goumy, Saint Egreve, France; Charles Defrancq, Zele, Belgium

[73] Assignee: L'Air Liquide, Societe Anonyme pour l'Etude et l'Exploitation des Procedes Georges Claude, Paris, France

[21] Appl. No.: 749,406

[22] Filed: Jun. 27, 1985

[30] Foreign Application Priority Data

Jun. 27, 1984 [FR] France ..... 84 10107

[51] Int. Cl.[4] ..... B22C 9/02

[52] U.S. Cl. ..... 164/159; 249/135; 249/81; 62/356

[58] Field of Search ..... 164/15, 159; 249/187 C, 249/81, 135; 62/356

[56] References Cited

U.S. PATENT DOCUMENTS

| | | | |
|---|---|---|---|
| 3,587,709 | 6/1971 | Miller et al. | 164/16 |
| 4,312,397 | 1/1982 | Harris et al. | 164/16 |

FOREIGN PATENT DOCUMENTS

| | | | |
|---|---|---|---|
| 0077247 | 4/1983 | European Pat. Off. . | |
| 57-28653 | 2/1982 | Japan | 164/15 |
| 57-22844 | 2/1982 | Japan . | |
| 57-106444 | 7/1982 | Japan | 164/15 |
| 57-106445 | 7/1982 | Japan | 164/15 |
| 58-35041 | 3/1983 | Japan | 164/16 |
| 2110578 | 6/1983 | United Kingdom | 164/16 |
| 2118079 | 10/1983 | United Kingdom | 164/15 |
| 971558 | 11/1982 | U.S.S.R. | 164/15 |
| 1014627 | 4/1983 | U.S.S.R. | 164/15 |

*Primary Examiner*—Tim Miles
*Attorney, Agent, or Firm*—Young & Thompson

[57] ABSTRACT

The device comprises a fixed gassing box (1) a moulding box (2) and a head (2A) for receiving and discharging gas. The box (2) is provided with a massive block (7) of aluminium which forms a pattern-plate and has a multitude of orifices (8) extending therethrough. This block has a sufficient thermal inertia to form a frozen crust as soon as the moulding box (2) is filled with a pre-moistened sand or the like. This permits obtaining a high rate of production of frozen moulds or cores having a very good surface condition, a good stability of shape and high and homogeneous mechanical properties.

13 Claims, 1 Drawing Figure

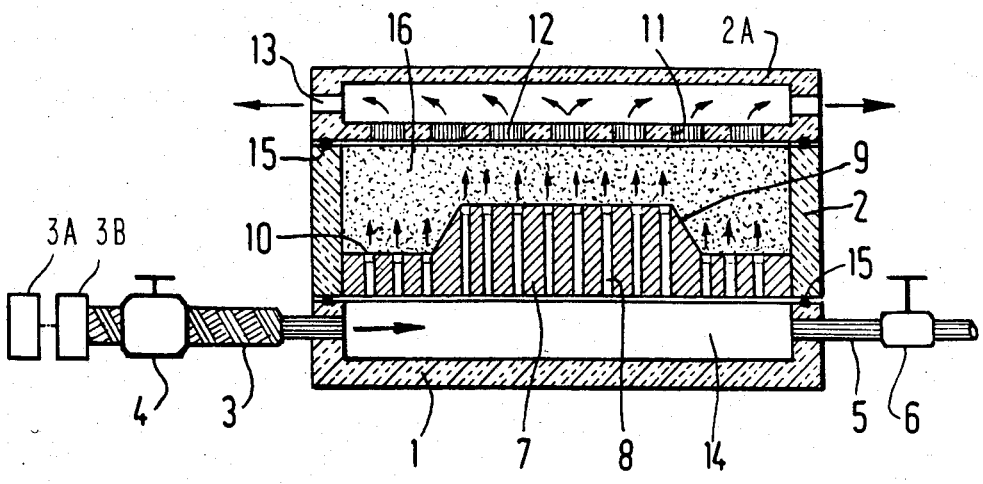
13
16
12
11
2A
15
9
2
3A
3B
10
15
4
3
1
7
8
14
5
6

DEVICE FOR FABRICATING FROZEN MOULDING MOULDS OR CORES

The present invention relates to a device for fabricating moulding moulds or cores from moistened and frozen particles, of the type comprising a cavity for receiving the particles provided with at least one forming wall, means for blowing a refrigerating fluid into said cavity through said wall, and means for exhausting gas located in opposed relation to said wall.

The applicant has proposed the basic principle of a device of this type in French patent application No. 81 19,038. In this known device the forming wall is a thin porous wall which does not give full satisfaction from the point of view of production rates, the surface condition of the moulds or cores produced and the mechanical properties of these objects.

An object of the invention is to provide a device capable of producing within a very short period moulds or cores having an excellent surface condition, a good stability of shape and high and homogenous mechanical properties so that they may be used in automatic installations mass-producing moulded parts.

The invention therefore provides a device of the aforementioned type, wherein the forming wall is formed by a surface of a massive block made from a thermally conductive material.

In a preferred embodiment, the block is provided with a multitude of orifices which extend between said wall and an opposed surface of the block which defines, in operation, a refrigerating fluid supply chamber. This permits the adaptation of the gassing at each point to the configuration of the moulds or core by so arranging that the density of the orifices at any place of said wall is roughly proportional to the thickness of the particles to be frozen in the region of this place.

An embodiment of the invention will now be described with reference to the accompanying drawing whose single FIGURE is a longitudinal sectional view of a device for fabricating semi-moulds of sand according to the invention.

The device shown in the drawing is adapted to fabricate semi-moulds from frozen sand. It essentially comprises three rigid parts: a gassing box 1, a moulding box 2 and a head 2A for recovering the gases.

The gassing box 1 is fixed in position, has the shape of a parallelepiped and is open in the upper part. This box is provided in a lateral wall with a thermally insulated conduit 3 having a valve 4 and connected to a refrigerating fluid source 3A, and, in the opposed lateral wall, with a venting conduit 5 provided with a valve 6. The refrigerating fluid is a cryogenic fluid such as gaseous nitrogen at a temperature around the desired freezing temperature (for example on the order of −100° C.) or compressed air or another appropriate gas cooled to a temperature on the same order by heat exchange, for example, with liquid nitrogen.

The box 2 is open at its upper and lower ends and has the same rectangular horizontal section as the gassing box 1. It is thermally insulated, as is the gassing box. Fixed in its lower part is a massive block 7 of aluminium forming a pattern-plate and provided with a multitude of vertical orifices 8. The lower side of the block 7 is planar and horizontal and is flush with the lower end edge of the box 2, while its upper side 9 constitutes the forming wall of the semi-moulds to be produced. Thus, the block 7 has a thickness which varies in accordance with the shape it is desired to give to the semi-moulds.

Each orifice 8 extends through the block 7 from the lower side to the upper side thereof. At the outlet ends of the orifices, the block is provided with a sand-retaining filter 10. At each place of the wall 9, the density of orifices 8 per unit area of this wall is substantially proportional to the thickness of the sand which surmounts this place during the freezing operation, which will be described hereinafter. This proportionality is however locally corrected in order to take into account other factors such as the proximity of the box 2, the object being to obtain at the latest at the end of freezing a substantially horizontal isothermal surface at the top of the frozen block of sand notwithstanding the non-planar shape of the wall 9.

The gas receiving head 2A is a thermally insulated box having the shape of a parallelepiped whose horizontal section is the same as that of the box 2. Its lower side is provided with a series of openings 11 each provided with a sand-retaining filter 12 and its lateral walls include gas exhaust openings 13.

The device just described operates in the following manner:

With the valve 4 closed and the valve 6 open, the box 2 carrying the block 7 is placed on the gassing box 1 and defines with the latter a refrigerating fluid supply chamber 14. For reasons which will be clear hereinafter, the block 7 is cold, i.e. it is at a temperature much lower than 0° C. The head 2A is maintained at a certain distance from the box 2.

The mass of sand to be frozen, previously moistened, is then "shot" into the box 2 by applying on the latter a shooting head (not shown) in the conventional manner. The venting conduit 5 enables the blowing gas and the air contained in the box 2 to escape during this shooting operation.

When the cavity defined by the box 2 and the wall 9 is filled, the shooting head is withdrawn, the valve 6 is closed and the head 2A is placed on the box 2, as shown in the drawing. The assembly is vertically pressed together by jacks (not shown) and the sealing between the three parts 1, 2 and 2A of the device is ensured by two peripheral sealing elements 15.

Thereafter, the valve 4 is opened so that the refrigerating fluid fills the chamber 14, passes through the orifices 8 of the block 7, passes through the mass of sand 16 in giving up its negative calories, and is discharged through the openings 11 and 13 of the head 2A. The sand is frozen and, when its desired temperature (for example −100° C.) is reached, the valve 4 is closed and the block of frozen sand is then stripped from the mould. For this purpose, the head 2A is raised, the box 2 is withdrawn horizontally from the device, and the frozen block is urged upwardly out of this box by ejection pins (not shown) which extend through corresponding passages provided in the pattern-plate constituting the block 7.

As the forming wall 9 is provided on a massive block 7 formed by a metal which is a good conductor of heat, this block possesses a great thermal inertia so that it remains cold between the end of a freezing operation and the beginning of the following shooting of the sand. Thus the wall 9 is capable of providing the sand with a sufficient amount of negative calories to enable it to freeze immediately as soon as it comes into contact with this wall. In this way, in the course of the shooting of the sand, there is almost immediately formed a crust of frozen sand which enables the mass of sand to easily support the mechanical force due to the gas pressure. Experience has shown that this frozen crust facilitates very much the obtainment of a good surface condition and a good shape stability of the parts produced.

Moreover, it was found that it was possible to choose the arrangement, the density and the passage section of the orifices 8 of the block 7 as a function of the geometry of the side 9, the thickness of the block of sand to be frozen and the desired cooling period so as to obtain a rapid and homogeneous cooling of the sand which results in good mechanical properties of the parts produced.

In order to avoid any marking of the sand in the region of the orifices 8 and any general displacement of the initially frozen crust, it has been found to be advantageous to gradually increase the blowing pressure of the refrigerating gas at the beginning of the freezing stage by suitable control means 3B inserted in conduit 3.

Note also that the fixed gassing box 1 may be supplied with cold gas through a rigid pipe 3 located at the rear of the machine while no moving part of the device requires connection with a thermally insulated conduit. This is very advantageous both from the point of view of the construction of the device and from the point of view of its placement in a moulding installation and in particular a foundry installation.

By way of a numerical example, there was employed a massive block 7 of aluminium having a thickness ranging between 1.5 and 3.5 cm and including 100 to 110 orifices 8 per square meter with a total passage section of the orifices 8 of 8 to 10 $cm^2/m^2$, and 0.75 to 1 $Nm^3$ of cold air per kilogram of sand to be cooled. Blocks of sand having a thickness of 5 cm were thus frozen in less than 30 seconds with the aforementioned advantages (mechanical properties, stability of shape, surface condition).

It will be understood that the device according to the invention may be easily adapted to the simultaneous production of two semi-moulds or the fabrication of moulding cores and that the sand may be replaced by any other type of material in the form of particles suitable for such applications.

What is claimed is:

1. A device for fabricating molding molds or cores from moistened and frozen particles, comprising means defining a cavity for receiving the particles and having at least one forming wall, means for blowing a refrigerating fluid into said cavity through said wall, and means for discharging gas located in opposed relation to said wall, said forming wall being formed by a surface of a massive block made from a thermally conductive material, said block comprising a multitude of orifices extending between said surface of said block and an opposed surface of said block which defines a refrigerating fluid supply chamber in operation of the device, said device further comprising means for progressively increasing the refrigerating fluid blowing pressure.

2. A device according to claim 1, wherein each orifice is provided with a filter at an end of the orifice adjacent to said wall.

3. A device according to claim 1, wherein the density of orifices in any place of said wall is substantially proportional to the thickness of the particles to be frozen in the region of said place.

4. A device according to claim 1, wherein the block is of aluminium.

5. A device according to claim 1, comprising a thermally insulated moulding box which surrounds said block and defines a periphery of said cavity, a thermally insulated gassing box having a refrigerating fluid inlet, a vent and an opening, a gas receiving head adapted to close said cavity, and comprising said gas discharging means, and means for applying said moulding box in a sealed manner on said opening of said gassing box and on said gas receiving head.

6. A device according to claim 5, wherein the gas receiving head has a wall adjacent to the moulding box which defines a series of openings each provided with a filter.

7. A device for fabricating molding molds or cores from moistened and frozen particles, comprising means defining a cavity for receiving the particles and having at least one forming wall, means for blowing a refrigerating liquid into said cavity through said wall, and means for discharging gas located in opposed relation to said wall, said forming wall being formed by a surface of a massive block made from a thermally conductive material, said block comprising a multitude of orifice extending between said surface of said block and an opposed surface of said block which defines a refrigerating fluid supply chamber in operation of the device, wherein the density of said multitude of orifices in any place of said wall is substantially proportional to the thickness of the particles to be frozen in the region of said place.

8. A device according to claim 7, wherein each orifice is provided with a filter at an end of the orifice adjacent to said wall.

9. A device according to claim 7, wherein the block is of aluminum.

10. A device according to claim 7; comprising means for progressively increasing the refrigerating fluid blowing pressure.

11. A device according to claim 7, comprising a thermally insulated molding box which surrounds said block and defines a periphery of said cavity, a thermally insulated gassing box having a refrigerating fluid inlet, a vent and an opening, a gas receiving head adapted to close said cavity, and comprising said gas discharging means, and means for applying said molding box in a sealed manner on said opening of said gassing box and on said gas receiving head.

12. A device according to claim 11, wherein the gas receiving head has a wall adjacent to the molding box which defines a series of openings each provided with a filter.

13. A device for fabricating molding molds or cores from moistened and frozen particles, comprising means defining a cavity for receiving the particles and having at least one forming wall, means for blowing a refrigerating fluid into said cavity through said wall, and means for discharging gas located in opposed relation to said wall, said forming wall being formed by a surface of a massive block made from a thermally conductive material, said block comprising a multitude of orifices extending between said surface of said block and an opposed surface of said block which defines a refrigerating fluid supply chamber in operation of the device, wherein the density of said multitude of orifices in any place of said wall is substantially proportional to the thickness of the particles to be frozen in the region of said place, said device further comprising means for progressively increasing the refrigerating fluid blowing pressure.

* * * * *